US007207564B2

(12) United States Patent
Bedford et al.

(10) Patent No.: US 7,207,564 B2
(45) Date of Patent: Apr. 24, 2007

(54) MECHANIZED BALL-THROWING GAME

(75) Inventors: Jonathan Bedford, Hawthorne, CA (US); Jim Keifer, Malibu, CA (US); Jeannie Burns Hardie, Gardena, CA (US)

(73) Assignee: Mattel, Inc., El Segundo, CA (US)

( * ) Notice: Subject to any disclaimer, the term of this patent is extended or adjusted under 35 U.S.C. 154(b) by 241 days.

(21) Appl. No.: 10/861,542

(22) Filed: Jun. 4, 2004

(65) Prior Publication Data

US 2005/0056994 A1 Mar. 17, 2005

Related U.S. Application Data

(60) Provisional application No. 60/476,814, filed on Jun. 6, 2003.

(51) Int. Cl.
*A63F 7/06* (2006.01)

(52) U.S. Cl. ..... 273/317; 273/317.3; 273/317.7; 273/371; 273/108.1; 273/108.31; 273/108.32; 273/370; 273/386; 273/390

(58) Field of Classification Search ..... 273/317, 273/317.3, 317.7, 371, 372, 108.1, 108.31, 273/108.32, 108.51–10, 369, 370, 386, 390–392
See application file for complete search history.

(56) References Cited

U.S. PATENT DOCUMENTS 2,431,552 A 11/1947 Gosnell
2,534,468 A 12/1950 Mitchell
2,926,914 A 3/1960 Miller
3,074,720 A 1/1963 Carver et al.
3,506,266 A * 4/1970 Wintersteen ..... 273/392
3,834,701 A 9/1974 Hashimoto
3,856,303 A 12/1974 Payne, Jr. et al.
3,907,293 A * 9/1975 Werner ..... 273/108.53
3,986,718 A 10/1976 Long et al.
4,033,584 A 7/1977 Smith
4,146,224 A 3/1979 Deutsch
4,216,963 A 8/1980 Boucher
4,548,408 A 10/1985 Clark
4,956,775 A * 9/1990 Klamer et al. ..... 473/480
4,976,434 A 12/1990 Wikner
5,125,658 A 6/1992 Francis et al.
5,330,175 A 7/1994 Kim
5,358,237 A 10/1994 Yu
5,418,517 A 5/1995 Matherne et al.
5,560,617 A 10/1996 Liang
5,595,387 A * 1/1997 Senna ..... 273/369
5,655,767 A 8/1997 Francis et al.
5,788,245 A * 8/1998 Hada ..... 273/392
5,810,362 A 9/1998 Jensen
5,876,036 A 3/1999 Mathis
6,439,570 B2 * 8/2002 Rossi et al. ..... 273/108.1

* cited by examiner

*Primary Examiner*—Nini F. Legesse
(74) *Attorney, Agent, or Firm*—Kolisch Hartwell, P.C.; Charles H. DeVoe; Timothy M. Whalen

(57) ABSTRACT

A mechanized ball-throwing game is provided, comprising at least one game play object, at least one rotating goal assembly, means to maintain a count of the number of times a game play object passes through each of the at least one rotating goal assembly in each of a plurality of designated directions, and means to display the count.

19 Claims, 3 Drawing Sheets

MECHANIZED BALL-THROWING GAME

CROSS-REFERENCE TO RELATED APPLICATIONS

This application claims priority under 35 U.S.C. 119(e) to U.S. Provisional Patent Application No. 60/476,814 entitled "Mechanized Ball-Throwing Game," filed Jun. 6, 2003, the disclosure of which is incorporated herein by reference.

FIELD OF THE DISCLOSURE

The present disclosure relates generally to a mechanized ball-throwing game or mechanized shooting match. More particularly, it relates to a game in which opposing players manipulate figures situated at opposite ends of a playing field, by using mechanical handles, to throw small balls through an array of rotating hoops in the center of the playing field. Each rotating hoop is provided with paddle means to electronically determine which player achieves each goal. Meanwhile, a random timing means triggers the release of a larger ball that the opposing players try to catch by hand, the catching of which by either player ends the game.

BACKGROUND OF THE DISCLOSURE

Examples of known mechanized games and figurines are found in U.S. Pat. Nos. 2,431,552; 2,534,468; 2,926,914; 3,074,720; 3,834,701; 3,856,303; 3,986,718; 4,033,584; 4,146,224; 4,216,963; 4,548,408; 4,976,434; 5,125,658; 5,330,175; 5,358,237; 5,418,517; 5,560,617; 5,655,767; 5,810,362; and 5,876,036, the disclosures of which are incorporated herein by reference.

SUMMARY

A mechanized ball-throwing game in which players compete for points by manipulating action figures to throw game play objects through an array of vertically oriented hoops is presented. Preferably, each hoop is positioned atop a rotating goal assembly to increase the challenge of the game, because correct aim as well as precise timing is required in order to score goals. The goal assemblies may rotate at different speeds and/or directions relative to each other.

Game play consists of scoring goals by manipulating the action figures to throw marbles through hoops, augmented by a contemporaneous event in which a larger and lighter ball is propelled into the air which each player attempts to catch before it makes contact with any surface.

The advantages of the present disclosure will be understood more readily after a consideration of the drawings and the Detailed Description of the Preferred Embodiment.

DETAILED DESCRIPTION OF THE PREFERRED EMBODIMENT

Figure 1:
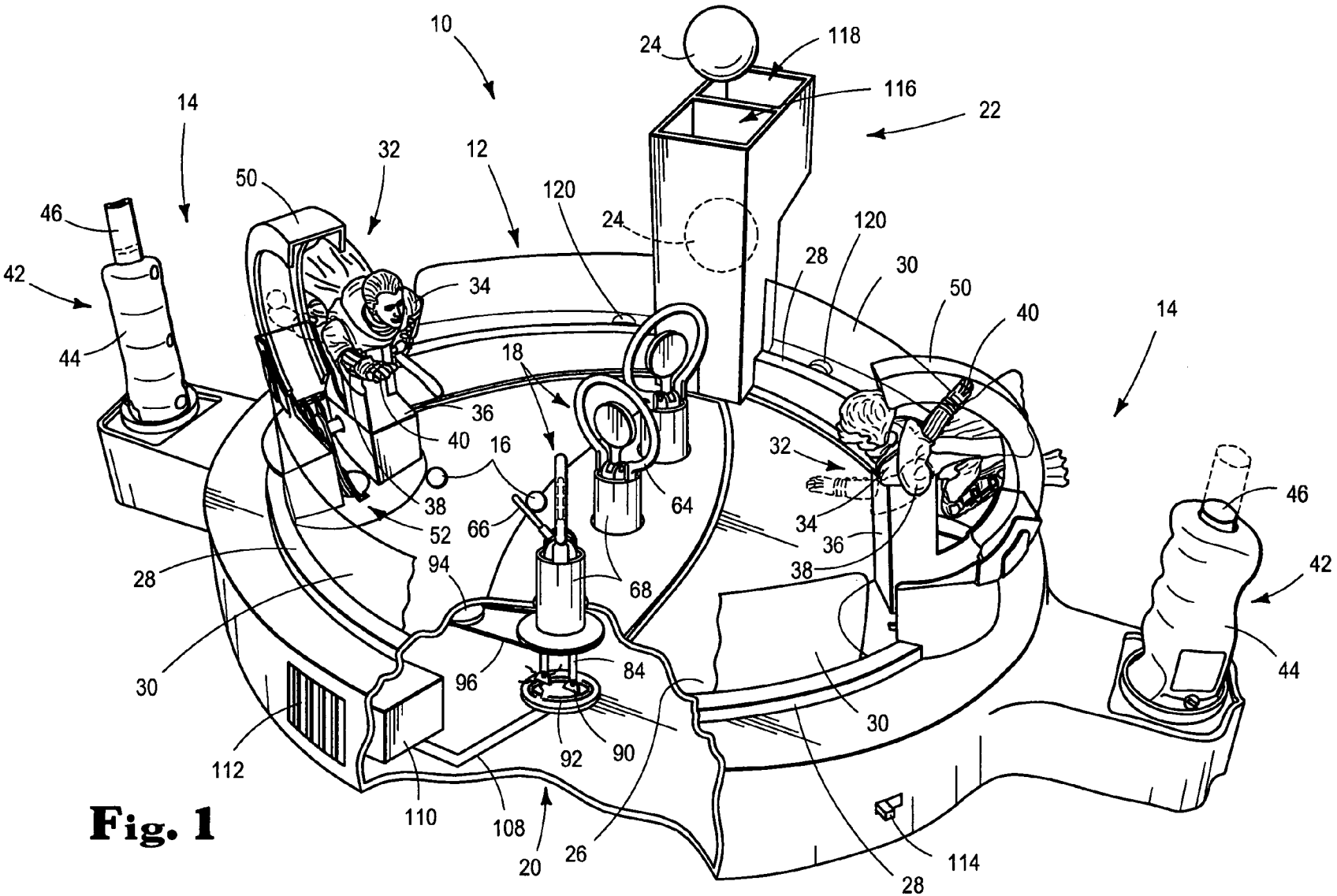
FIG. 1 is an isometric view of a game according to the present disclosure, including a playing field with three goal assemblies in the center of the field, and action figure assemblies at opposite ends of the field. A portion of the playing field is cut away to show internal structure.

A ball-throwing game constructed according to the present disclosure is indicated generally at 10 in FIG. 1. Game 10 includes a play area 12, at either end of which is situated an action figure assembly 14. Each action figure assembly 14 is adapted to aim and throw a plurality of small play objects 16 at an array of goal assemblies 18.

Game 10, as shown in the exemplary embodiment described below, depicts two action figure assemblies 14 positioned at opposite ends of play area 12. However, it is within the scope of this disclosure that more than two action figure assemblies 14 may be included. For example, there may be three or more action figure assemblies 14 situated about the periphery of play area 12.

The exemplary embodiment as shown also features three goal assemblies 18 positioned substantially at the center of play area 12, but it should be understood that there may be one, two, or more than three goal assemblies 18. Goal assemblies 18 rotate with respect to play area 12. Goal assemblies 18 may all rotate at the same speed and in the same direction, but preferably rotate at different speeds and/or in different directions with respect to each other.

Various arrangements of action figure assemblies 14 and goal assemblies 18, other than that shown in the exemplary embodiment, also are possible and are within the scope of this disclosure. For example, an alternative embodiment may feature a row of three action figure assemblies at one end of the play area, throwing small play objects at a row of three goal assemblies at the opposite end of the play area.

Goal assemblies 18 are coupled to a score assembly 20. Score assembly 20 is adapted to respond to goal assemblies 18, and to count the goals scored. Score assembly 20 may also indicate the score. As explained in more detail below, the configuration of rotating goal assemblies 18 and scoring assembly 20 provides means for assuring that each player is correctly awarded credit for each goal.

Game 10 further includes a chute 22, which is adapted to eject a large play object 24 into the air above play area 12. Large play object 24 is indicated to resemble a ping-pong ball, which typically is lighter and larger than small play objects 16, and thus may be easier to catch by a human player. However, large play object 24 may be any suitable size or shape for this purpose.

Still referring to FIG. 1, play area 12 includes a play surface 26, which preferably is generally elliptical in shape, but may be square, rectangular, circular, or shaped in any other way to accommodate the particular arrangement of the action figure assemblies and goal assemblies. Play surface 26 is generally flat, but may include inclined surface sections to cause small play objects 16 to roll toward the closest action figure assembly 14. Thus, small play objects 16, without requiring manual direction, roll naturally toward action figure assemblies 14 to a position available to be thrown.

The periphery of play surface 26 is generally bounded by a set of walls 28, situated to extend vertically upwards from play surface 26. Walls 28 further feature a plurality of guards 30, adapted to ensure that small play objects 16 stay within play area 12. Small play objects 16 are propelled through the air above play surface 26 as game players attempt to score goals. Since several small play objects may be flying through the air at once, guards 30 are necessary to prevent any small play objects from flying or bouncing outside play area 12. Guards 30 thus serve to protect the players of the game from being struck, and to ensure that small play objects 16 are prevented from escaping play area 12.

Game 10 requires eye-to-hand coordination to play, thus guards 30 are preferably made of transparent material so that each game player's view of play area 12 and goal assemblies 18 is not obstructed or impaired. Guards 30 are shown in FIG. 1 to extend upwards from walls 28 to a fixed height, but guards 30 may vary in height around the periphery of play surface 26, or may extend upwards to completely enclose play area 12.

Action figure assembly 14 includes an action figure 32. Action figure 32 has a body 34, positioned atop a vertical post 36, preferably in a simulated flying posture. Action figure 32 also features an arm 38 rotatable about a shoulder portion of body 34. Arm 38 terminates in a hand 40.

Figure 2:
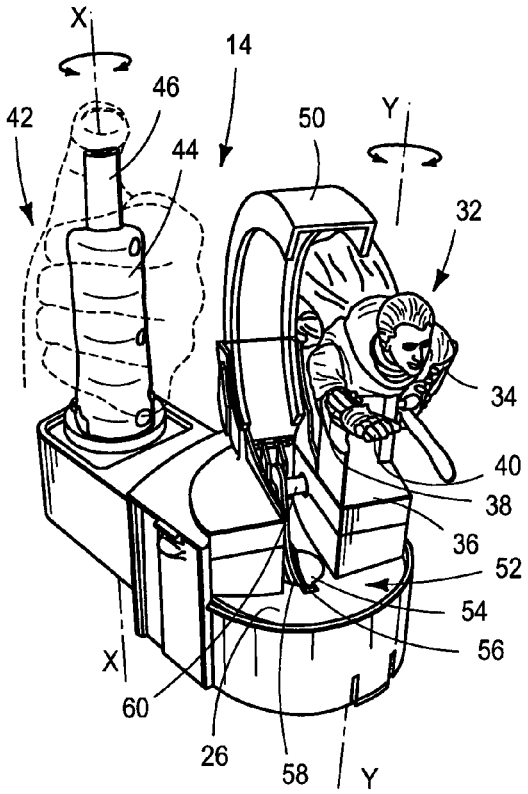
FIG. 2 is an isometric view of one of the action figure assemblies shown in FIG. 1, including a rotating handle and a similarly rotating action figure, with vertical axes of rotation shown in dashed lines.
Figure 3:
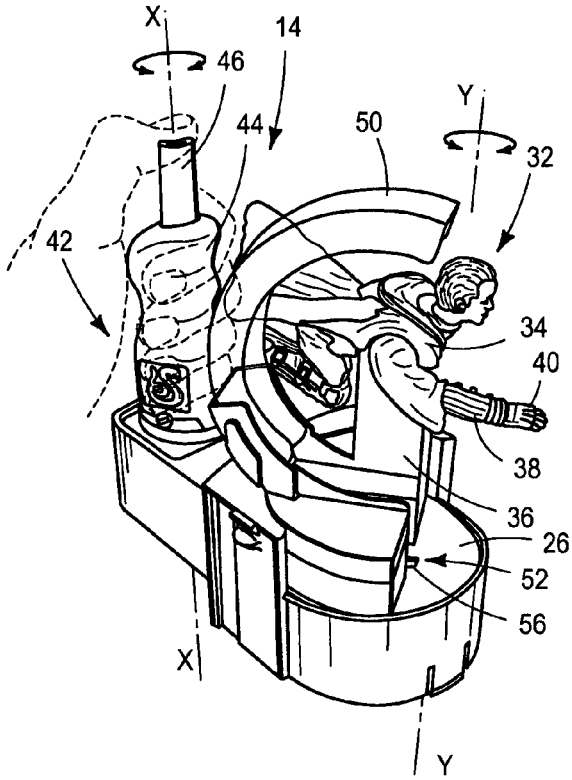
FIG. 3 is an isometric view of the action figure assembly of FIG. 2, shown with the handle and action figure rotated to a different orientation from the orientation of FIG. 2.

A more detailed view of action figure assembly 14 is found in FIGS. 2 and 3. Arm 38 is biased to extend horizontally outwards from body 34, consistent with a simulated flying posture. However, arm 38 is adapted to move through an allowed range of rotation about the shoulder of body 34 in a scooping motion, the purpose of which will be described in more detail below.

Action figure assembly 14 is controlled by means of a handle 42, which consists of a grip 44 and a button 46. Grip 44 is oriented vertically and is adapted to be grasped by a player's hand, as indicated by the dashed structure in FIGS. 2 and 3. Button 46 extends vertically from the top of handle 42, configured to accommodate the thumb of the player's hand. As can be seen by comparing FIG. 2 with FIG. 3, when handle 42 is grasped and rotated about vertical axis X—X, action figure 32 rotates in tandem about post 36 and corresponding vertical axis Y—Y, allowing action figure assembly 14 to be oriented in a chosen direction.

Action figure assembly 14 further includes a curvilinear launching track 50, attached to action figure 32. A feed mechanism 52 is situated near the bottom of launching track 50. Launching track 50 and feed mechanism 52 allow action figure 32 to throw small play objects 16.

Feed mechanism 52 includes a depression 54, adapted to receive small play object 16. Depression 54 further includes a slot 56. Recessed within slot 56 is a holder 58, which rotates about an axle 60 and rises through slot 56.

Depressing button 46 simultaneously moves arm 38 of action figure 32 and feeding mechanism 52, so that arm 38 scoops downward toward feeding mechanism 52 as feeding mechanism 52 lifts one small play object 16 into position. Arm 38 then continues past feeding mechanism 52, propelling small play object 16 along launching track 50.

Play surface 26 preferably is inclined or biased to cause small play object 16 to roll toward action figure assembly 14, due to gravitational forces, and come to rest in depression 54. Thus, when small play object 16 has rolled into depression 54, holder 58 lifts small play object 16 into position to be scooped up by hand 40 and pushed through launching track 50.

When button 46 is depressed fully, arm 38 stops rotating. However, the momentum of small play object 16 causes small play object 16 to continue through and out of launching track 50 and to fly through the air away from action figure assembly 14.

Figure 4:
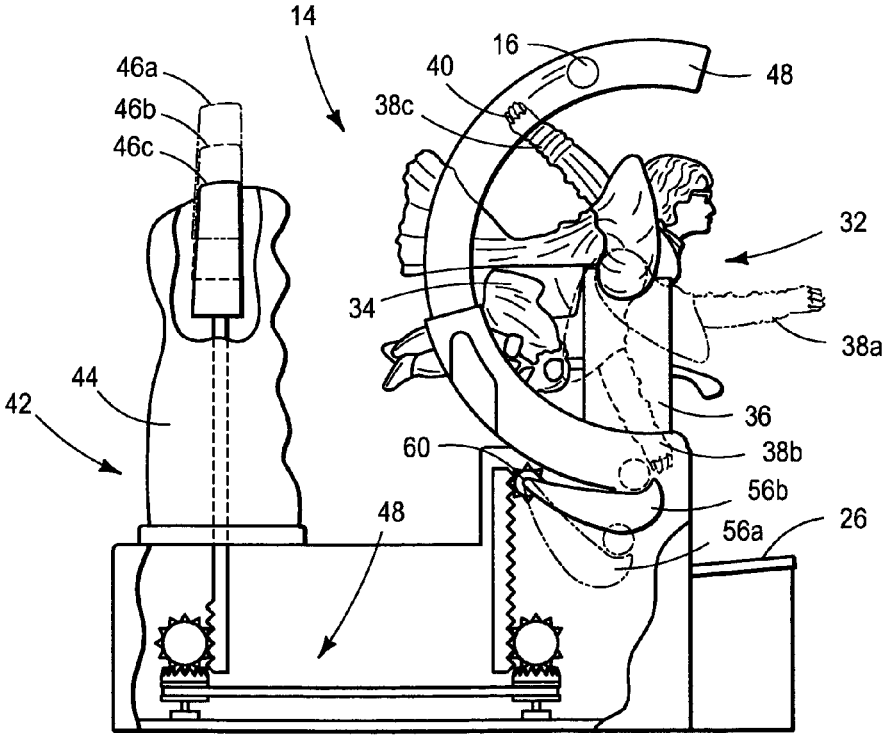
FIG. 4 is a side elevation view of the action figure assembly of FIG. 2 with portions of the assembly cut away to show internal structure.

The coordination of button 46 with arm 38 and holder 58, and the relative movement of said structure, can be more clearly understood by referring to FIG. 4. For clarity, the position of arm 38 extending horizontally outwards from body 34 is designated as the "ready" position 38*a*. Similarly, the position of arm 38 when hand 40 engages play object 16 is designated as the "engage" position 38*b*, and the position of arm 38 when arm 38 stops rotating is designated as the "throw" position 38*c*.

Thus, referring specifically to FIG. 4, "ready" position 38*a* is represented by a first set of dashed lines. Similarly, "engage" position 38*b* is represented by a second set of dashed lines. Finally, "throw" position 38*c* is represented by solid lines.

Analogously, the three positions 46*a*–46*c* of button 46 correspond with positions 38*a*–38*c* of arm 38, and are correspondingly represented by a first set of dashed lines, a second set of dashed lines, and solid lines, respectively. Finally, holder 58 in a recessed position 58*a* is represented by dashed lines, and holder 58 in a raised position 58*b* is represented by solid lines.

Still referring specifically to FIG. 4, it can be seen that depressing button 46 to position 46*b* moves arm 38 to "engage" position 38*b* as holder 58 moves to raised position 58*b*, at which point hand 40 engages small play object 16. Continuing to depress button 46 continues the movement of arm 38, propelling small play object 16 along launching track 50. When button 46 is fully depressed in position 46*c*, arm 38 stops at "throw" position 38*c*, and the momentum of small play object 16 causes small play object 16 to continue through and out of launching track 50.

Arm 38 remains in "throw" position 38*c* until button 46 is released. As button 46 is released, arm 38 returns to "ready" position 38*a*. Similarly, holder 58 remains in raised position 58*b* until button 46 is fully released, at which point holder 58 returns to recessed position 58*a* in slot 56, and action figure 32 and feed mechanism 52 are ready to throw another small play object 16.

It can thus be understood that in the illustrated embodiment, arm 38 is configured to move bidirectionally through an allowed arc of motion, beginning in "ready" position 38*a*, moving into and through "engage" position 38*b*, and ending in "throw" position 38*c*, and back again. Stopping the rotation of arm 38 abruptly in "throw" position 38*c* prevents any interference of hand 40 with the trajectory of play object 16 after small play object 16 has gained sufficient momentum to move freely up and out of launching track 50. However, the described movement of arm 38 is not intended to limit this disclosure to the preferred embodiment. For example, arm 38 could be adapted to move freely in full 360-degree rotation, or in only one direction.

Similarly, maintaining holder 58 in raised position 58*b* until button 46 is fully released prevents play objects 16 from rolling into depression 54 while arm 38 is moving, which might interfere with the manipulation of action figure assembly 14. Allowing holder 58 to move into recessed position 58*a* only after button 46 is fully released ensures smooth operation of feed mechanism 52. However, different configurations of feed mechanism 52 are possible.

Coordinating button 46 with arm 38, and coordinating the orientation of action figure 32 and launching track 50 with handle 42, may be accomplished by any suitable mechanism known in the art. For example, in the illustrated embodiment depicted in FIG. 3, action figure assembly 14 includes a gear assembly 48, which couples handle 42 to action figure 32.

In the exemplary embodiment, handle 42 is configured to allow the aim of launching track 50 to be changed while game play object 16 is being propelled through launching track 50 and before game play object 16 is released. This configuration also allows action figure 32 to be manipulated with one hand, by means of handle 42, allowing each player to have the other hand free to participate in another aspect of game play, as will be described. It should be appreciated, however, that any direct or indirect coupling system, involving gears, belts, wiring harnesses and other suitable linkages may be used to couple handle 44 to action figure 32. Also, the manipulation of action figure assembly 14 is preferably mechanical, although the mechanical movements may be augmented or replaced by electronic means adapted to accomplish the same results.

Figure 5A:
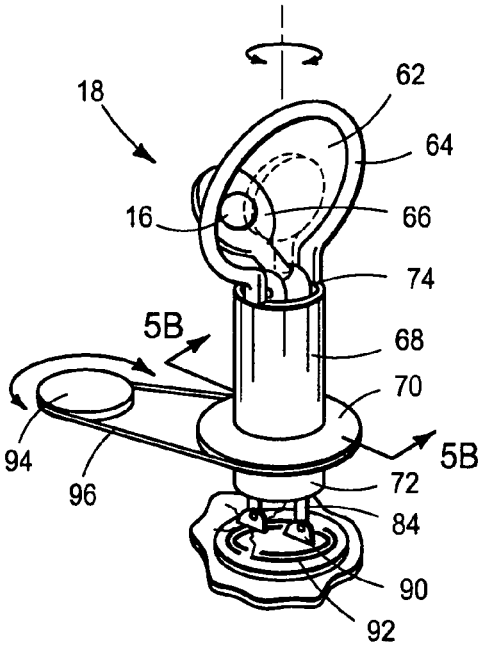
FIG. 5A is an isometric view of one of the goal assemblies of FIG. 1, shown separately.
Figure 5B:
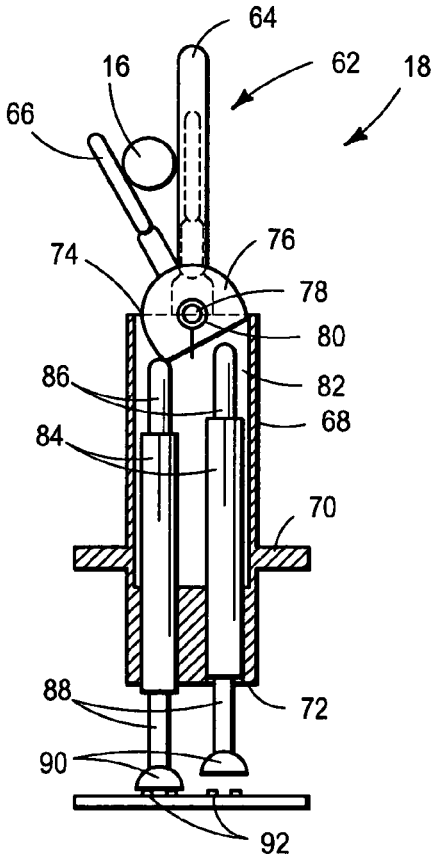
FIG. 5B is a cross-sectional view of the goal assembly of FIG. 5A, viewed along line 5B—5B of FIG. 5A.

The configuration of goal assembly 18 may be more clearly understood by referring to FIGS. 5A and 5B, which depict an isometric exterior view and a cross-sectional elevation view, respectively, of a first embodiment of goal assembly 18 consistent with this disclosure.

Goal assembly 18 includes a target region 62, which defines a vertically oriented plane encircled by a hoop 64. Positioned within hoop 64 and affixed at the circumference of hoop 64 is a paddle 66. Paddle 66 is configured to remain upright and substantially within the plane described by hoop 64, but is adapted to move out of target region 62 if urged by an applied force, such as that imparted if struck by small play object 16.

In FIGS. 5A and 5B, small play object 16 is shown passing through hoop 64 and pushing paddle 66 out of target region 62. The dashed structure represents paddle 66 in an upright position.

Hoop 64 is positioned atop a vertical post 68, which features an annular flange 70 and a base 72. Post 68 also includes a top slot 74. Paddle 66 extends upwardly from the interior of post 68 through top slot 74.

Referring specifically to FIG. 5B, the structure that allows paddle 66 to move out of target region 62 is illustrated. A cam 76 is positioned at the base of paddle 66, within top slot 74. Cam 76 rotatably moves about a hinge 78, allowing attached paddle 66 to move out of target region 62. When not being moved, paddle 66 is urged upright by a spring 80, which couples cam 76 to an interior wall 82 of post 68.

Still referring to FIG. 5B, post 68 contains a plurality of plungers 84 positioned vertically within post 68. Each plunger 84 includes a top end 86 and a bottom end 88. In this embodiment, bottom ends 88 extend downwardly from base 72 and terminate in tabs 90. Tabs 90 are spaced for selective engagement of a plurality of contacts 92, positioned beneath tabs 90.

When paddle 66 moves out of target region 62, cam 76 correspondingly rotates about hinge 78 and engages top end 86 of one of the plungers 84. When so engaged, plunger 84 is pushed downward, and tab 90 is downwardly extended. Because of the relative configuration of tabs 90 and contacts 92, tab 90 touches a set of contacts 92 when paddle 66 is moved out of target region 62.

FIG. 5B depicts paddle 66 being moved in one direction relative to target region 62, extending one of tabs 90 and touching one set of contacts 92. It can thus be easily understood that when paddle 66 is moved in the opposite direction to that indicated in FIG. 5B, cam 76 engages the other of plungers 84, which results in the other of tabs 90 touching the other set of contacts 92.

Referring back to FIG. 5A, it can be seen that goal assembly 18 is coupled to a drive gear 94 by means of a drive belt 96, which encircles flange 70 of post 68. In this manner, drive gear 94 rotates goal assembly 18 relative to play area 12, action figure assemblies 14, and, more specifically in this embodiment, relative to contacts 92.

Contacts 92 are shown arranged in semi-circular manner underneath tabs 90. The semi-circular arrangement of contacts 92 accommodates the rotation of goal assembly 18 and, more specifically, the orbit described by the rotation of plungers 84.

In this embodiment, contacts 92 comprise two generally concentric sets of metal rails, and tabs 90 are made of metal or some other conductive material. As can also be seen by referring to FIG. 1, the two sets of contacts 92 do not form continuous concentric circles, but are separate from each other along a line corresponding approximately to the line midway between the opposing action figure assemblies 14. Thus, each set of contacts 92, defining two generally concentric semicircles, corresponds to one of the two action figure assemblies 14.

In use it can be understood that contacts 92 are arranged underneath goal assembly 18 such that one of plungers 84 will be engaged by cam 76 and touch the same corresponding set of contacts 92 each time the paddle 66 is moved in one direction relative to target region 62, no matter what orientation goal assembly 18 bears relative to contacts 92.

However, this disclosure is not limited to the specific arrangement described in this embodiment. For example, if there are more than two action figure assemblies 14, there could be a corresponding number of contacts 92, arranged to divide up the circular orbit described by the rotation of plungers 84 into separate portions for the action figure assemblies 14. Also, each action figure assembly 14 may correspond to one of contacts 92, or to a specific set of contacts 92, or to a unique combination of at least one of contacts 92.

Figure 6A:
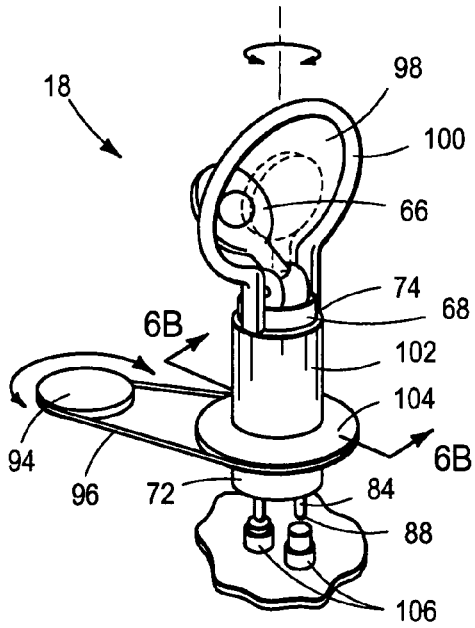
FIG. 6A is an isometric view of an alternative embodiment of a goal assembly suitable for use in the game of FIG. 1.
Figure 6B:
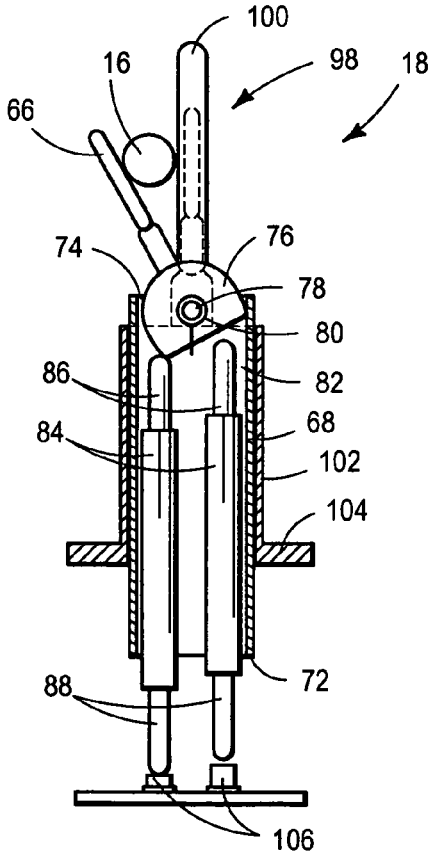
FIG. 6B is a cross-sectional view of the goal assembly of FIG. 6A, viewed along line 6B—6B of FIG. 6A.

A second embodiment of goal assembly 18 is depicted in FIGS. 6A and 6B, in which goal assembly 18 is shown to include a target region 98, which defines a vertically oriented plane encircled by a hoop 100. Positioned within hoop 100 is a paddle 66. Paddle 66 is configured to remain upright, but is adapted to move out of vertical alignment if urged by an applied force. The remaining parts of the embodiment in FIGS. 6A and 6B correspond to parts of the embodiment in FIGS. 5A and 5B, and thus bear the same part numbers as referenced in the description above.

In this second embodiment, hoop 100 is positioned atop an exterior cylinder 102, which features an annular flange 104. Post 68 is concentrically situated within exterior cylinder 102. This arrangement allows either post 68 or exterior cylinder 102 to rotate freely with respect to the other. For example, post 68 may be fixedly positioned, and exterior cylinder 102 may rotate around post 68.

Post 68 also includes a base 72 and a plurality of vertically positioned plungers 84, each of which terminate in a bottom end 88. Bottom ends 88 extend downwardly from base 72 and are spaced for selective engagement of a plurality of contacts 106, which in this embodiment resemble buttons or pressure switches.

The internal structure of goal assembly 16 in the second embodiment is similar to that described with respect to the first embodiment. Referring specifically to FIG. 6B, it can be seen that when paddle 66 moves from vertical alignment, cam 76 correspondingly rotates about hinge 78 and engages top end 86 of one of plungers 84. When so engaged, bottom end 88 of plunger 84 is pushed downward from base 72. Because of the relative configuration of bottom ends 88 and contacts 106, bottom end 88 touches contact 106 when paddle 66 is moved from vertical alignment.

FIG. 6B depicts paddle 66 being moved in one direction relative to hoop 100, extending bottom end 88 of one of plungers 84 and touching one of contacts 106. It can thus be easily understood that when paddle 66 is moved in the opposite direction to that indicated in FIG. 6B, cam 76 engages the other of plungers 84, which results in bottom end 88 of the other of plungers 84 touching the other contacts 106.

Referring back to FIG. 6A, it can be seen that goal assembly 18 is coupled to drive gear 94 by means of drive belt 96, which encircles flange 104 of exterior cylinder 102. In this manner, drive gear 94 rotates exterior cylinder 102 and attached hoop 100 relative to post 68, paddle 66, and plungers 84.

Contacts 106 are shown simply as two buttons, corresponding to the two directions in which paddle 66 can move. In this embodiment, plungers 84 remain stationary relative to contacts 106. Accordingly, contacts 106 need only be responsive to the downward extension of each of non-rotating plungers 84.

In use it can be understood that contacts 106 are arranged underneath goal assembly 18 such that one of plungers 84 will be engaged by cam 76 and touch the same corresponding one of contacts 106 each time the paddle 66 is moved in one direction relative to contacts 106. However, if there are more than two action figure assemblies 14, there could be a corresponding number of contacts 106. Also, each action figure 14 assembly may correspond to one of contacts 106, or to a specific set of contacts 106, or to a unique combination of at least one of contacts 106.

Goal assemblies 18 and contacts 92, as described above and illustrated in detail in FIGS. 5A and 5B, are visible as well in FIG. 1. Also shown in FIG. 1 is scoring assembly 20, which further includes a set of circuitry 108. Circuitry 108 connects contacts 92 to a microprocessor 110.

Circuitry 108 is configured such that when one of plungers 84 is engaged and tab 90 is downwardly extended to touch a corresponding set of contacts 92, an electrical circuit is completed across contacts 92. This is indicated by the jagged lines in FIG. 1 and, in greater detail, FIG. 5A. When tab 90 touches contacts 92, circuitry 108 sends a signal to microprocessor 110.

Microprocessor 110 is preferably configured to keep a count of the number of signals from each set of contacts 92, and to increment this count every time a signal is received. In this manner, microprocessor 110 can keep score by maintaining a separate tally of goals for each action figure 14.

Note that circuitry 108 as shown is a schematic view, and that there could be biasing and other circuitry, such as an analog-to-digital converter or a threshold trigger, in between contacts 92 and microprocessor 110.

Microprocessor 110 may further include a display component to indicate the score, such as a visual display, an audio display, or a display of some combination of visual and audio signals. For example, the exemplary embodiment includes an audio display in the form of a speaker 112. Speaker 112 is configured to emit a sound signal every time microprocessor 110 receives a signal.

Thus, when one of action figure assemblies 14 successfully propels small play object 16 through one of goal assemblies 18, a corresponding one of tabs 90 engages a combination of at least one of contacts 92, completing an electric circuit. This in turn causes circuitry 108 to send a signal to microprocessor 110, and microprocessor 110 in turn prompts speaker 112 to emit a sound signal to indicate the goal.

Preferably, microprocessor 110 can prompt speaker 112 to emit a variety of distinct sound signals. For example, speaker 112 may emit a distinct "score" sound signal for each action figure assembly 14, indicating which of action figure assemblies 14 is awarded credit for each goal. Microprocessor 110 may also be configured to prompt speaker 112, at intervals, to emit a "leader" sound signal to indicate which of action figure assemblies 14 has achieved the greatest amount of goals. Finally, microprocessor 110 may prompt speaker 112 to emit a "winner" sound at the end of the game to designate the winner of the game.

Activation of microprocessor 110 is controlled by a power switch 114. Power switch 114 may also be adapted to activate drive gear 94 and/or any other electronic or electric systems required for game play.

Additional structural features of chute 22 are indicated in FIG. 1. Chute 22, oriented to extend upwardly from wall 28, comprises a launch channel 116 and a ready channel 118. Situated on either side of chute 22 are buttons 120, corresponding to action figure assemblies 14.

Chute 22 is adapted to eject large play object 24 out of launch channel 116 and into the air above play area 12, and is also adapted to store additional large play objects 24 in ready channel 118. If launch channel 116 is empty, chute 22 is internally configured to allow one of any large play objects 24 stored in ready channel 118 to move into position in launch channel 116.

A first large play object 24, indicated by solid lines, is shown as ejected from launch channel 116 of chute 22. A second large play object 24, indicated by dashed lines, is shown as having moved into position to be ejected in launch channel 116.

Chute 22 may include timing means to trigger the ejecting of large play objects 24 from launch channel 116. Such timing means may be configured to trigger the ejection of large play objects 24 at random or at regular intervals, and may be accomplished by any means known in the art. For example, timing means may be mechanically coupled to drive gear 94. However, it will be appreciated that said timing means may be electronically coupled to microprocessor 110 or operated by a separate electronic or mechanical process.

Situated on either side of chute 22 are buttons 120, which are coupled to microprocessor 110. The pressing of one of buttons 120 preferably prompts microprocessor 110 to increment the score of whichever of action figures 14 corresponds to the button pressed, to tally the score for each of action figures 14, and to indicate which of action figures 14 has achieved the highest score.

Preferably, chute 22 ejects large play object 24 from launch channel 116 at a random time after power switch 114 has been activated. As described in more detail below, the pressing of one of buttons 120 preferably relates to the catching of large play object 24 by one of the players of the game, and may be designated as a game-ending event In the exemplary embodiment, this disclosure also includes a method for using the above-described apparatus, wherein players attempt to manipulate action figure assemblies 14 to score goals.

Preferably, two opposing players manipulate corresponding action figure assemblies 14 situated at opposite ends of play area 12, by means of handles 42. A plurality of small play objects 16 are released onto play surface 26. A plurality of goal assemblies 18 are positioned in a row, along a line midway between action figure assemblies 14, in the center of play surface 26.

Each player tries to score points by manipulating action figure 14 to throw small play objects 16 through target regions 62 of goal assemblies 18. Each player aims at a desired goal assembly 18 by rotating handle 42 about its vertical axis, correspondingly rotating action figure 32 and attached curvilinear track 50. Handle 42 also allows a player to throw small game objects 24 by pressing button 46, as previously described.

Scoring goals is made more difficult because each of goal assemblies 18 rotates continuously about a vertical axis. The rotating of goal assemblies 18 is driven by drive gear 94, which is activated when power switch 114 is turned on. Power switch 114 also activates microprocessor 110, which tallies and indicates the score achieved by each player.

In the exemplary embodiment, a player scores points each time said player's corresponding action figure assembly 14 throws small play object 16 through hoop 64 of goal assembly 18. As described above, when small play object 16 passes through hoop 64, microprocessor 110 increments the score held by the player that scored the goal, regardless of which direction paddle 66 is tipped relative to hoop 64.

While players are attempting to score goals, random timing means triggers chute 22 to eject large play object 24 from launch channel 116 and into the air above play area 12. Players attempt to catch large play object 24 before said play object contacts any surface.

If large play object 24 makes contact with any surface before being caught, said play object is no longer in play. However, if a player catches large play object 24, that player presses corresponding button 120. Pressing button 120 prompts microprocessor 110 to add points to that player's score. Preferably, the catching of large play object 24 by either player is designated as a game-ending event.

The scoring system of the game may add an additional strategic element to the game by assigning a different point value to each point-scoring event. For example, in the exemplary embodiment, ten points are awarded each time a player scores a goal, and 150 points are awarded when large play object 24 is caught and button 120 is pressed. Also, the catching of large play object 24 ends the game. Thus, each player must decide whether to attempt to catch large play object 24 when it is randomly ejected from chute 24, or perhaps whether to interfere with the other player's attempt to catch large play object 24, because if one player is more than 150 points behind the other player, the former would lose the game if either of them were to catch large play object 24.

In the exemplary embodiment, players keep track of their scores by listening to sound signals emitted by speaker 112. When a player successfully scores a goal, microprocessor 110 prompts speaker 112 to emit a distinct "score" sound signal corresponding to the player who scored. Preferably, microprocessor 110 prompts speaker 112 at regular intervals to emit a distinct "leader" sound to indicate which player is currently in the lead.

Microprocessor 110 also prompts speaker 112 to emit an additional, different sound if the player in the lead is leading by more than 150 points. When one player catches large play object 24 and presses corresponding button 120, microprocessor 110 determines which player has accumulated the greater amount of points, and prompts speaker 112 to emit a "winner" sound to indicate the winner of the game.

Although the invention has been disclosed in its preferred forms, the specific embodiments thereof as disclosed and illustrated herein are not to be considered in a limiting sense, because numerous variations are possible. The subject matter of this disclosure includes all novel and non-obvious combinations and subcombinations of the various elements, features, functions, and/or properties disclosed herein. No single feature, function, element or property of the disclosed embodiments is essential. The following claims define certain combinations and subcombinations of features, functions, elements, and/or properties that are regarded as novel and nonobvious. Other combinations and subcombinations may be claimed through amendment of the present claims or presentation of new claims in this or a related application. Such claims, whether they are broader, narrower, equal, or different in scope to any earlier claims, also are regarded as included within the subject matter of this disclosure.

We claim:

1. A sensor for use in a game comprising:

a goal having a target region, a paddle positioned substantially within the target region, the paddle configured to move in a plurality of directions relative to the target region;

a plurality of plungers coupled to the paddle, and a plurality of contacts;

wherein the plurality of plungers is spaced for selective engagement of the plurality of contacts, such that one of the plurality of plungers will engage a corresponding combination of at least one of the plurality of contacts for each of the plurality of directions in which the paddle is configured to move.

2. The sensor of claim 1 wherein the plurality of plungers rotate with respect to the plurality of contacts, and wherein the plurality of contacts are disposed in a substantially circular arrangement corresponding to the orbit described by the rotation of the plurality of plungers.

3. The sensor of claim 2, further comprising a counter connected to the plurality of contacts, wherein the counter is configured to count the plunger engagements for each of the plurality of directions.

4. An electronic game including at least one sensor according to claim 1.

5. A sensor for use with a game, comprising:

a plurality of contacts, a plurality of plungers spaced for selective engagement of the plurality of contacts, and a paddle coupled to the plurality of plungers, the paddle configured to move in a plurality of directions relative to the plurality of plungers;

wherein one of the plurality of plungers engages a corresponding combination of at least one of the plurality of contacts upon movement of the paddle in each of the plurality of directions in which the paddle can move.

6. The sensor of claim 5 further comprising electronic circuitry coupled to the plurality of contacts, such that whenever one of the plurality of plungers engages a corresponding combination of at least one of the plurality of contacts, the electronic circuitry will express a signal.

7. The sensor of claim 6 wherein the paddle and the plurality of plungers rotate about a common axis relative to the plurality of contacts, and wherein the plurality of contacts are disposed in a substantially circular arrangement corresponding to the orbit described by the plurality of the plungers.

8. The sensor of claim 7 wherein the electronic circuitry expresses a distinct electronic signal for each of the plurality of directions in which the paddle is configured to move.

9. An electronic game comprising:

a counter, an output configured to emit a plurality of report signals, and at least one sensor according to claim 5;

wherein the counter is configured to count the times the paddles in each of the at least one sensor moves in each of the plurality of directions, and wherein the output will emit a corresponding report signal whenever the paddle in each of the at least one sensor moves in any of the plurality of directions.

10. The electronic game of claim 9, further comprising:

at least one action figure, at least one game play object, at least one curvilinear launching track;

wherein each of the at least one action figure is configured to push one of the at least one game play object into one of the at least one curvilinear launching track in a direction substantially away from the at least one sensor, and said curvilinear launching track is configured to turn the momentum of said game play object and launch it in a direction substantially toward the at least one sensor.

11. A game comprising:

at least one action figure, at least one curvilinear launching track, at least one game play object, and at least one goal assembly further comprising:

a target region, a paddle positioned substantially within the target region, the paddle configured to move in a plurality of directions relative to the target region; and means to indicate each of the plurality of directions of movement of the paddle, the means configured to be responsive to the movement of the paddle;

wherein each of the at least one action figure is configured to push one of the at least one game play objects in a direction substantially away from the at least one goal assembly into one of the at least one curvilinear launching track, and said curvilinear launching track is configured to turn the momentum of said game play object and launch it in a direction substantially toward the at least one goal assembly.

12. The game of claim 11, wherein said means to indicate the direction of movement of the paddle comprises:

a plurality of plungers, and a plurality of contacts, spaced for selective engagement of the plurality of plungers;

such that each of the plurality of plungers will engage a corresponding combination of at least one of the plurality of contacts, for each direction in which the paddle is configured to move.

13. The game of claim 12 wherein the plurality of plungers rotates with respect to the plurality of contacts, and wherein the plurality of contacts are disposed in a substantially circular arrangement corresponding to the orbit described by the rotation of the plungers, in each of the at least one goal assembly.

14. The game of claim 13, further comprising means for keeping a count of the number of times each of the plurality of plungers engages a corresponding combination of at least one of the plurality of contacts for each of the plurality of directions, and means for indicating said count.

15. The game of claim 14, further comprising:

a play area, timing means, and an eject chute;

wherein the timing means triggers the eject chute to release a game play object outside the play area.

16. The game of claim 15 wherein the game play object released from the eject chute is adapted to be launched vertically into the air above the play area.

17. A game comprising:

at least one game play object, at least one rotating goal assembly, means to maintain a count of the number of times a game play object passes through each of the at least one rotating goal assembly in each of a plurality of designated directions, and means to display the count.

18. A sensor for use with a game, comprising:

a plurality of contacts, a plurality of plungers spaced for selective engagement of the plurality of contacts, and a paddle coupled to the plurality of plungers, the paddle configured to move in a plurality of directions relative to the plurality of plungers;

electronic circuitry coupled to the plurality of contacts;

wherein the paddle and the plurality of plungers rotate about a common axis relative to the plurality of contacts;

wherein the plurality of contacts are disposed in a substantially circular arrangement corresponding to the orbit described by the plurality of the plungers; and wherein one of the plurality of plungers engages a corresponding combination of at least one of the plurality of contacts, and the electronic circuitry expresses a signal, upon movement of the paddle in each of the plurality of directions in which the paddle can move.

19. The sensor of claim 18 wherein the electronic circuitry expresses a distinct electronic signal for each of the plurality of directions in which the paddle is configured to move.

* * * * *